US005622217A

United States Patent [19]

Iwamoto et al.

[11] Patent Number: 5,622,217

[45] Date of Patent: Apr. 22, 1997

[54] INJECTION APPARATUS FOR A DIE CASTING MACHINE

[75] Inventors: Norihiro Iwamoto, Sagamihara; Yutaka Nakamura, Zama, both of Japan

[73] Assignee: Toshiba Kikai Kabushiki Kaisha, Tokyo-to, Japan

[21] Appl. No.: 528,465

[22] Filed: Sep. 14, 1995

[30] Foreign Application Priority Data

Sep. 14, 1994 [JP] Japan ..... 6-220374

[51] Int. Cl.[6] ..... B22D 17/32

[52] U.S. Cl. ..... 164/457; 164/312; 164/155.3; 164/154.1; 164/113

[58] Field of Search ..... 164/457, 154.1, 164/4.1, 155.3, 312, 113

[56] References Cited

U.S. PATENT DOCUMENTS 5,299,626 4/1994 Iwamoto ..... 164/457

FOREIGN PATENT DOCUMENTS 54-18218 7/1979 Japan .

2-225020 9/1990 Japan ..... 164/457

4-75756 3/1992 Japan ..... 164/312

*Primary Examiner*—Joseph J. Hail, III

*Assistant Examiner*—I.-H. Lin

*Attorney, Agent, or Firm*—Cushman Darby & Cushman IP Group of Pillsbury Madison & Sutro LLP

[57] ABSTRACT

Operation can be switched from low- or high-speed injection process to intensified-pressure injection process by using only one accumulator, and an injection cylinder is composed of a single-acting cylinder, so that the space can be saved, and intensified-pressure surge can be reduced. A coaxial small-diameter portion is formed on the pressure surface side of a piston of the accumulator, a hydraulic oil discharge passage having an inside diameter corresponding to the outside diameter of the small-diameter portion is provided coaxial with the piston, and a passage is provided for guiding intensified-pressure oil in a cylinder chamber of the accumulator.

3 Claims, 4 Drawing Sheets

INJECTION APPARATUS FOR A DIE CASTING MACHINE

BACKGROUND OF THE INVENTION

1. Field of the Invention

The present invention relates to an injection apparatus of a die casting machine, in which injection operation is switched in three stages, low-speed injection process, high-speed injection process, and intensified-pressure injection process, by means of a piston-type accumulator.

2. Information Disclosure of the Related Art

In the die casting, after the molten metal is injected in the die under high-speed injection process, when the molten metal is solidified under the intensified-pressure injection process, it comes intimately into contact with the die so that its texture is very fine. Moreover, those drawbacks which are attributable to shrinkage by solidification are removed to ensure production of high-quality castings.

Thus, the injection apparatus of the die casting machine is constructed so that the injection speed can be changed for low- or high-speed injection process, the pressure on the molten metal in the cavity can be intensified after high-speed injection process (see Jpn. Pat. Appln. KOKOKU Publication. No. 54-18218).

Generally, in the injection apparatus of the die casting machine of this type, moreover, an accumulator is used in order to obtain the high-speed injection process. Accumulators conventionally used in hydraulic circuits of injection apparatuses may be classified into two types, piston type and bladder type.

FIG. 4 is a circuit diagram showing a hydraulic circuit of a direct-coupled injection apparatus of the piston type which utilizes a piston-type accumulator, among other conventional injection apparatuses having a function to switch injection operation.

In FIG. 4, numeral 60 denotes a piston-type accumulator for accumulating hydraulic oil. The accumulator 60 is connected to an injection cylinder section 63, which is formed of a duplex cylinder, through a high/low-pressure valve 61 and an intensified-pressure valve 62.

The high/low-pressure valve 61 includes a pilot check valve for switching the injection mode between low-speed injection and high-speed injection process, and feeds the hydraulic oil into a head-side cylinder chamber of a speed cylinder 64 of the injection cylinder section 63.

On the other hand, the intensified-pressure valve 62 feeds the hydraulic oil into a head-side cylinder chamber of a pressure cylinder 65 which is exclusively used to intensify the pressure of the injection cylinder section 63.

In the direct-coupled injection apparatus of the piston type constructed in this manner, the hydraulic oil from the accumulator 60 is fed through the high/low-pressure valve 61 into the speed cylinder 68 in a first low-speed injection process. In switching the injection mode to high-speed injection process, the high/low-pressure valve 61 is switched to a two-step opening so that the hydraulic oil is fed at a higher flow rate into the speed cylinder 64. In intensifying the pressure on the molten metal in the cavity, the intensified-pressure valve 62 is opened to allow the hydraulic oil to be fed from the accumulator 60 into the pressure cylinder 65, whereupon the piston advances. Thus, the pressure on the molten metal can be intensified, while a pilot-check valve of the high/low-pressure valve 61 is closed to prevent the hydraulic oil from reversing into the high/low-pressure valve 61.

FIG. 5 is a hydraulic circuit diagram showing a hydraulic circuit of an injection apparatus of the single-acting accumulator type which utilizes a bladder-type accumulator.

This injection apparatus is provided with first and second rubber accumulators 46 and 47. The pressure of hydraulic oil accumulated in the first accumulator 46 is adjusted for low- or high-speed injection process, while the pressure of hydraulic oil accumulated in the second accumulator 47 is increased for intensified-pressure injection process.

A simplex cylinder is used as an injection cylinder 48, and pressure oil is supplied from the first accumulator 46 to the head side of the cylinder 48 through an intensified-pressure valve 49. On the other hand, pressure oil is supplied from the second accumulator 47 to the injection cylinder 48 through an intensified-pressure valve 50.

In executing low-speed injection in the injection apparatus constructed in this manner, the operating speed of the injection cylinder 48 is adjusted to a low speed injection process by restricting the flow rate of the hydraulic oil on the outlet side of the cylinder 48 by means of a low-speed valve 51. In switching the injection mode from the low-speed injection process to the high-speed injection process, meter-out control is effected such that the pilot pressure is applied to a check valve 52 to open it, thereby increasing the flow rate of the hydraulic oil on the outlet side of the injection cylinder 48. In starting the intensified-pressure injection, the pilot valve acting on the check valve of the intensified-pressure valve 50 is released to open the valve 50, thereby changing the control mode to intensified-pressure injection control. Numeral 53 denotes a relief valve through which the hydraulic oil is delivered from the injection cylinder 48.

However, the prior art piston-type injection apparatus requires use of the exclusive cylinder 65 for intensified pressure besides the intensified-pressure cylinder 64, so that the injection cylinder section 63 is inevitably bulky as a whole.

According to the injection cylinder of the single-acting accumulator type, on the other hand, the pressure of the hydraulic oil must be controlled by means of the accumulators 46 and 47 are provided for the low- or high-speed injection process and the intensified-pressure injection process, thus requiring an additional installation space for the accumulators.

SUMMARY OF THE INVENTION

Accordingly, the object of the present invention is to provide an injection apparatus of a die casting machine, in which operation can be switched from low- or high-speed injection to intensified-pressure injection by using only one accumulator, and an injection cylinder is composed of a single-acting cylinder, so that the space can be saved, and intensified-pressure surge can be reduced.

In order to achieve the above object, according to the present invention there is provided an injection apparatus for a die casting machine, comprising:

an injection cylinder for injecting a molten metal in a die cavity and operated by hydraulic oil;

a hydraulic circuit for controlling injection operation of the injection cylinder for low-speed injection, high-speed injection, and intensified-pressure operation such that the casting pressure is increased after a cavity is loaded with a molten metal; and a piston-type accumulator for accumulating hydraulic oil to be fed into the injection cylinder through said hydraulic circuit, said accumulator including:

a piston having a pressure surface;

a small-diameter portion coaxially formed on the pressure surface side of the piston;

a hydraulic oil discharge passage having an inside diameter corresponding to the outside diameter of the small-diameter portion and coaxial with the piston; and a passage for guiding intensified-pressure oil in a cylinder chamber of the accumulator, such that the pressure thereof is intensified by utilizing the ratio between the pressure area of the piston and the area of the small-diameter portion, whereby the oil is delivered to an intensified-pressure oil circuit through the guide passage.

When the piston advances so that its small-diameter portion closes the hydraulic oil discharge passage, the pressure area of the piston for the hydraulic oil is reduced to a value obtained by subtracting the area of the small-diameter portion from the sectional area of the piston, and the hydraulic oil is pressurized by only the end face of that portion of the piston except the small-diameter portion. Thus, there is a relation $$AP=(A-a)P1,$$

where A is the sectional area of the piston, a is the sectional area of the small-diameter portion, P is a pressure for the low- or high-speed injection process, and P1 is a pressure for the intensified-pressure process. Accordingly, the pressure area becomes narrower than in the case of the low- or high-speed injection process. As a result, the pressure of the hydraulic oil is increased, and the oil is fed into the injection cylinder. With this increase of the hydraulic oil pressure, the injection cylinder performs intensified-pressure injection.

According to the present invention, a coaxial small-diameter portion is formed on the pressure surface side of a piston of the accumulator, a hydraulic oil discharge passage having an inside diameter corresponding to the outside diameter of the small-diameter portion is provided coaxial with the piston, and a passage is provided for guiding intensified-pressure oil in a cylinder chamber of the accumulator, whereby the oil is delivered to an intensified-pressure oil circuit through the guide passage. Thus, an injection cylinder section of the die casting machine can be made compact, and accumulators incorporated in the hydraulic circuit can be reduced by one in number. Thus, the space can be saved, and the pressure control is easy. By the use of the simplex cylinder, moreover, the injection cylinder section of the die casting machine can be made compact and small-sized. Since the piston-type accumulator itself can serve additionally as an intensified-pressure cylinder, furthermore, intensified-pressure surge can be reduced more effectively than in the conventional case where the pressure is intensified by opening or closing the valve.

DETAILED DESCRIPTION OF THE PREFERRED EMBODIMENTS

One embodiment of an injection apparatus of a die casting machine will be described in detail with reference to the accompanying drawings.

Figure 1:
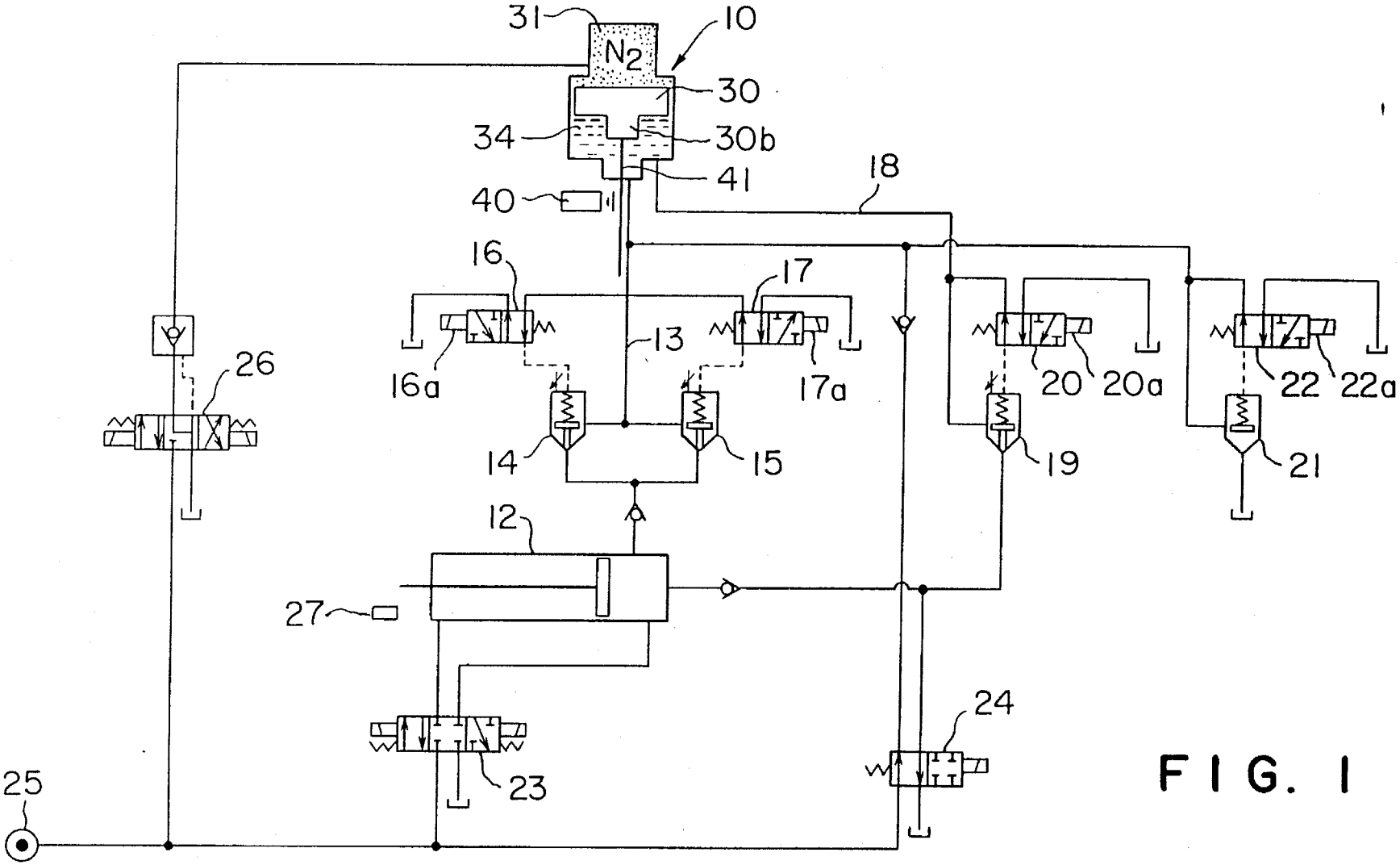
FIG. 1 is a hydraulic circuit diagram of an injection apparatus of a die casting machine according to one embodiment of the present invention.

FIG. 1 is a circuit diagram of a hydraulic circuit which constitutes the injection apparatus of the die casting machine. In FIG. 1, numerals 10, 12 and 27 denote an accumulator, an injection cylinder, and a position sensor for detecting the position of the injection cylinder, respectively.

Hydraulic oil accumulated in the accumulator 10 is fed into a cylinder chamber on the side of the head of the injection cylinder 12 through a line 13. The line 13 is provided with low- and high-speed pilot check valves 14 and 15 arranged in parallel with each other, whereby the injection speed is switched between low- and high-speed injection processes. The low-speed pilot check valve 14 is opened and closed under a pilot pressure which is supplied through a solenoid valve 16 for low-speed control. The check valve 14 is opened when a solenoid **16*a* of the solenoid valve 16 is energized in response to an injection start signal. Likewise, the high-speed pilot check valve 15 is opened when a solenoid 17*a* of a solenoid valve 17** for high-speed control is energized.

Also, hydraulic oil for intensified-pressure injection process is fed from the accumulator 10 into the injection cylinder 12 through an intensified-pressure line 18. Numeral 19 denotes an intensifying pilot check valve, on which a pilot pressure for closing the valve acts through a solenoid valve 20.

A relief pilot check valve 21 is opened when a solenoid **22*a* of a solenoid valve 22 for controlling the pilot pressure is energized as high-speed injection process is changed over to intensified-pressure injection process. Thereupon, the hydraulic oil in a cylinder of the accumulator 10** is discharged into a tank.

Numeral 23 denotes a four-port two-position solenoid-operated directional control valve for controlling the movement of the injection cylinder 12. Numeral 24 denotes an accumulator loading valve. When the valve 24 is opened, the hydraulic oil is fed from a hydraulic oil source 25 into a cylinder chamber 34 of the accumulator 10. Numeral 26 designates a four-port two-position solenoid-operated directional control valve for casting pressure adjustment, through which the hydraulic oil is fed from the hydraulic oil source 25 into a pressure chamber in the accumulator 10 to adjust the gas pressure therein.

Figure 2:
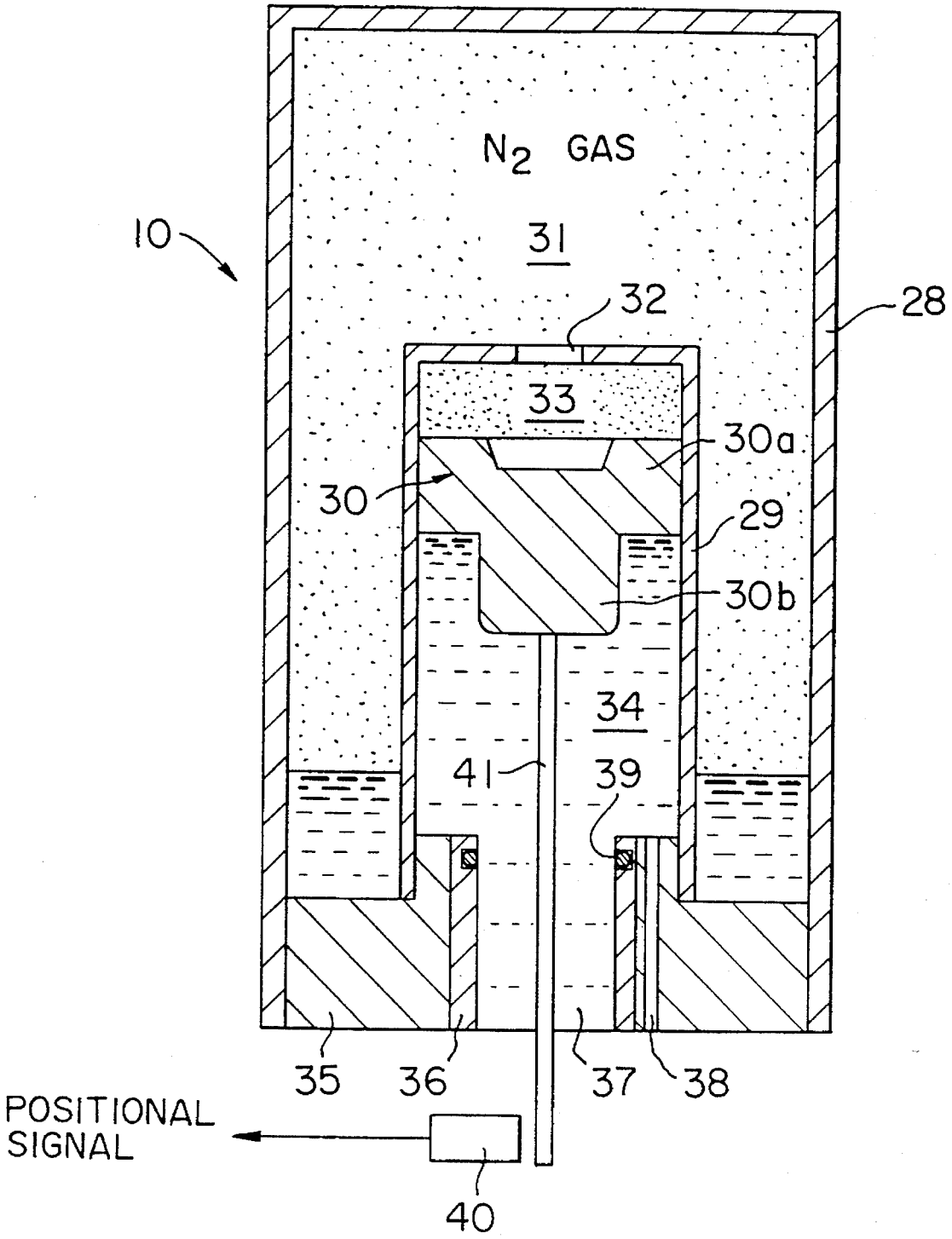
FIG. 2 is a longitudinal sectional view showing an arrangement of an accumulator of the injection apparatus shown in FIG. 1.

Referring now to FIG. 2, an arrangement of the accumulator 10 will be described.

The accumulator 10 is of a type which incorporates a booster cylinder. A cylinder 29 for the piston is contained coaxially in a closed casing 28, and a piston 30 is slidably fitted in the cylinder 29.

A pressure chamber 31, which is defined between the closed casing 28 and the cylinder 29, is loaded with compressed gas, e.g., nitrogen or other inert gas. In order to adjust the pressure of the compressed gas, the hydraulic oil from the hydraulic oil source 25 is supplied through the valve 26 for casting pressure adjustment.

The pressure chamber 31 in the closed casing 28 and the cylinder chamber 34 in the cylinder 29 communicate with each other by means of an inlet port 32. When the piston 30 advances under the pressure of the compressed gas, the oil in the cylinder chamber 34 is pressurized and forced out. The oil is delivered to the line 13 shown in FIG. 1 through a hydraulic oil discharge passage 37 defined by a sleeve 36 which is formed in a lower header 35 so as to be coaxial with the piston 30.

The piston 30 is an integral piston which includes a large-diameter portion 30*a* in sliding contact with the cylinder 29 and a small-diameter portion 30*b* adapted to be fitted liquid-tight in the sleeve 36 with the aid of a seal 39. When the piston 30 advances, its small-diameter portion 30*b* is fitted in the sleeve 36, so that the oil discharge passage 37 is closed. In order to discharge the intensified-pressure oil, an intensified-pressure passage 38 is formed in the lower header 35. The oil is delivered to the intensified-pressure line 18 through the intensified-pressure passage 38.

A position sensor 40 is used as means for detecting the position of the piston 30, while a position detecting rod 41 is connected to the piston 30. Thus, a piston positional signal is delivered to a control unit (not shown) as the displacement of the rod 41 is detected by means of the position sensor 40. The position detecting rod 41 may be fixed on the nitrogen gas side of the piston 30.

The following is a description of the injection apparatus according to the present embodiment constructed in this manner.

When an injection cycle is started, the solenoid 16*a* of the solenoid valve 16 for low-speed control is first energized to initiate the low-speed injection process. As a result, the low-speed pilot check valve 14 is opened as the pilot pressure is released to the tank side, whereupon the hydraulic oil is fed from the accumulator 10 into the injection cylinder 12 through the line 13. Thus, the injection cylinder 12 carries out the low-speed injection process.

In switching the injection mode from the low-speed injection process to the high-speed injection process, the solenoid 17*a* of the solenoid valve 17 is energized. Thereupon, the high-speed pilot check valve 15 is opened to cause the flow rate of the hydraulic oil to be fed into the injection cylinder 12 to increase, so that the operation of the cylinder 12 is changed to the high-speed injection process.

Figure 3:
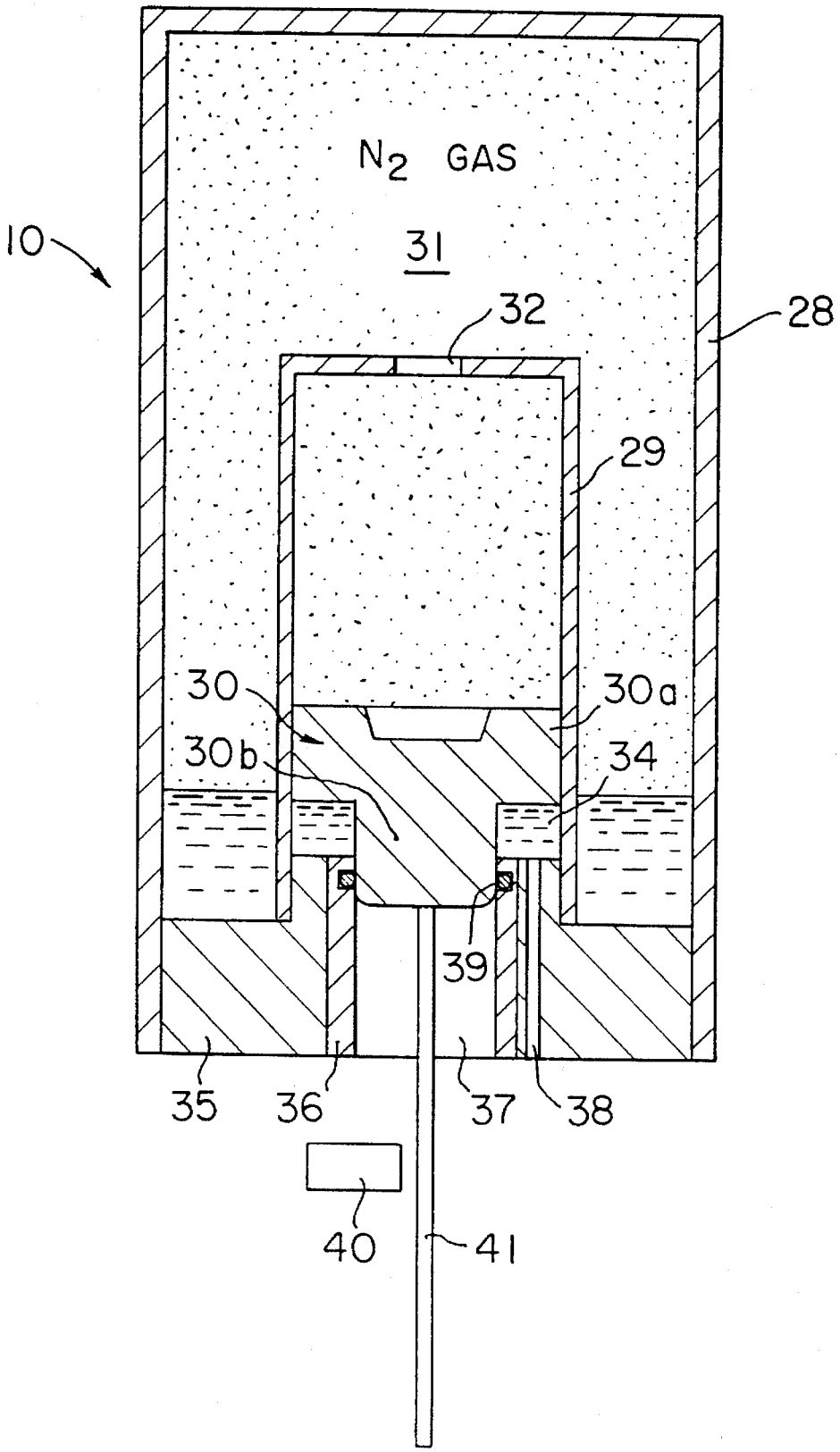
FIG. 3 is a longitudinal sectional view illustrating the operation of the accumulator in a mode for intensified-pressure operation.
Figure 4:
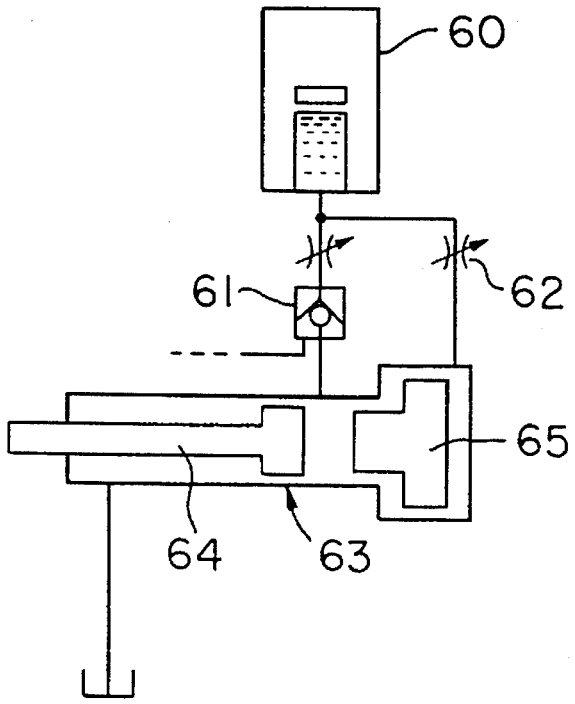
FIG. 4 is a hydraulic circuit diagram of a conventional direct-coupled injection apparatus of the piston type.
Figure 5:
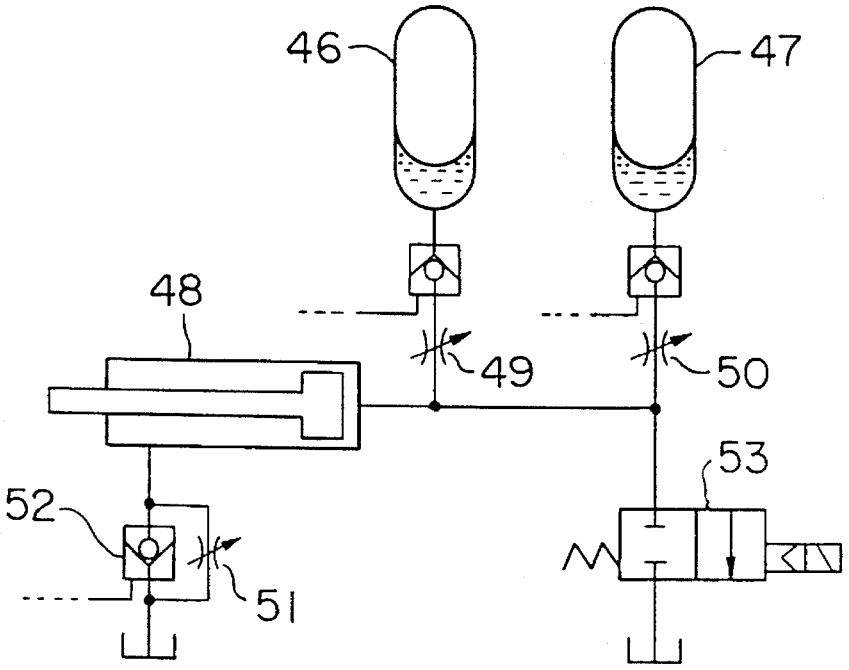
FIG. 5 is a hydraulic circuit diagram of a conventional injection apparatus of the accumulator type.

When a cavity of a die (not shown) is loaded with a molten metal as the high-speed injection advances, the small-diameter portion 30*b* of the piston 30 reaches the inlet of the sleeve 36 in the accumulator 10, as shown in FIG. 3. Thereupon, the position of the piston 30 is detected by means of the position sensor 40, and the low- and high-speed pilot check valves 14 and 15 are closed as their corresponding solenoid valves 16 and 17 are de-energized. At the same time, the solenoid valve 20 is energized to open the intensifying pilot check valve 19.

At this point of time, the hydraulic oil discharge passage 37, which is defined by the sleeve 36, is closed by the small-diameter portion 30*b* of the piston 30, so that the hydraulic oil in the cylinder chamber 34 flows through the intensified-pressure passage 38 and the intensified-pressure line 18, and is fed into the injection cylinder 12 via the intensifying pilot check valve 19.

In this manner, the hydraulic oil circuit is switched to an intensified-pressure, and the oil in the cylinder chamber 34 is pushed by only the end face of the large-diameter portion 30*a* of the piston 30. Thus, there is a relation $$AP=(A-a)P1,$$

where A is the sectional area of the piston 30, a is the sectional area of the small-diameter portion 30*b*, P is a pressure for the low- or high-speed injection process, and P1 is a pressure for the intensified-pressure process. Accordingly, the pressure area of the piston 30 becomes narrower than in the case of the low- or high-speed injection process. As a result, the pressure of the hydraulic oil is increased, and the oil is fed into the injection cylinder 12. With this increase of the hydraulic oil pressure, the injection cylinder 12 performs intensified-pressure injection process.

The intensified pressure can be set in accordance with the ratio between the respective sectional areas A and a of the piston 30 and the small-diameter portion 30*b*.

Before the injection process is switched over to the intensified-pressure process, the position of the small-diameter portion 30*b* of the piston 30 must reach the inlet of the sleeve 36 when the die cavity finishes being loaded with the molten metal.

After the injection process is finished, the accumulator loading valve 24 is opened so that the cylinder chamber 34 of the accumulator 10 is loaded with the hydraulic oil. In this case, the valve 24 may be designed so that it is closed when the piston position calculated according to preceding and past data is detected by means of the position sensor 40. Thus, the operation mode can be switched properly to the intensified-pressure process.

According to the present invention, as described herein, a coaxial small-diameter portion is formed on the pressure surface side of a piston of the accumulator, a hydraulic oil discharge passage having an inside diameter corresponding to the outside diameter of the small-diameter portion is provided coaxial with the piston, and a passage is provided for guiding intensified-pressure oil in a cylinder chamber of the accumulator, whereby the oil is delivered to an intensified-pressure oil circuit through the guide passage. Thus, an injection cylinder section of the die casting machine can be made compact, and accumulators incorporated in the hydraulic circuit can be reduced by one in number. Thus, the space can be saved, and the pressure control is easy. By the use of the simplex cylinder, moreover, the injection cylinder section of the die casting machine can be made compact and small-sized. Since the piston-type accumulator itself can serve additionally as an intensified-pressure cylinder, furthermore, intensified-pressure surge can be reduced more effectively than in the conventional case where the pressure is intensified by opening or closing the valve.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An injection apparatus for a die casting machine, comprising:

an injection cylinder for injecting a molten metal in a die cavity and operated by hydraulic oil;

a hydraulic circuit for controlling injection operation of the injection cylinder for low-speed injection, high-speed injection, and intensified-pressure operation such that the casting pressure is increased after a cavity is loaded with a molten metal; and a piston-type accumulator for accumulating hydraulic oil to be fed into the injection cylinder through said hydraulic circuit, said accumulator including:

a piston having a pressure surface;

a small-diameter portion coaxially formed on the pressure surface side of the piston;

a hydraulic oil discharge passage having an inside diameter corresponding to the outside diameter of the small-diameter portion and coaxial with the piston; and a passage for guiding intensified-pressure oil in a cylinder chamber of the accumulator, such that the pressure thereof is intensified by utilizing the ratio between the pressure area of the piston and the area of the small-diameter portion, whereby the oil is delivered to an intensified-pressure oil circuit through the guide passage.

2. The injection apparatus for a die casting machine according to claim 1, which further comprises position detecting means for detecting the position of the piston and arranged at a rod side thereof, and wherein loading the accumulator with the hydraulic oil is controlled in accordance with the piston position.

3. The injection apparatus for a die casting machine according to claim 1, wherein hydraulic oil accumulated in the accumulator is fed into said injection cylinder through a line, and the line is provided with low- and high-speed pilot check valves arranged in parallel with each other, whereby the injection speed is switched between low and high levels.

* * * * *